US006817734B2

(12) United States Patent
Hauck

(10) Patent No.: US 6,817,734 B2
(45) Date of Patent: Nov. 16, 2004

(54) METHOD AND APPARATUS FOR USING AN ELECTRICALLY ILLUMINATED ATTENTION-ATTRACTING DEVICE

(75) Inventor: Lane T. Hauck, 5346 Bragg St., San Diego, CA (US) 92122

(73) Assignee: Lane T. Hauck, San Diego, CA (US)

( * ) Notice: Subject to any disclaimer, the term of this patent is extended or adjusted under 35 U.S.C. 154(b) by 23 days.

(21) Appl. No.: 10/150,691

(22) Filed: May 17, 2002

(65) Prior Publication Data

US 2003/0214808 A1 Nov. 20, 2003

(51) Int. Cl.[7] ..... F21V 9/00

(52) U.S. Cl. ..... 362/231; 362/35; 362/800; 362/185

(58) Field of Search ..... 362/231, 35, 103, 362/101, 102, 104, 105, 106, 107, 108, 800, 184, 185; 315/200 A, 185 S, 209 R, 246; 340/815.45

(56) References Cited

U.S. PATENT DOCUMENTS

| | | | | | |
|---|---|---|---|---|---|
| 4,142,801 | A | * | 3/1979 | Calder et al. | 356/251 |
| 4,161,018 | A | * | 7/1979 | Briggs et al. | 362/104 |
| 5,697,695 | A | * | 12/1997 | Lin et al. | 362/184 |
| 5,932,975 | A | * | 8/1999 | Wut | 315/119 |
| 6,012,822 | A | * | 1/2000 | Robinson | 362/103 |
| 6,206,537 | B1 | * | 3/2001 | Hauck | 362/102 |
| 6,217,188 | B1 | * | 4/2001 | Wainwright et al. | 362/103 |
| 6,265,984 | B1 | * | 7/2001 | Molinaroli | 340/815.4 |

* cited by examiner

*Primary Examiner*—Sandra O'Shea
*Assistant Examiner*—Sharon Payne
(74) *Attorney, Agent, or Firm*—Duckor Spradling Metzger & Wynne; Bernard L. Kleinke

(57) ABSTRACT

The disclosed embodiments of the present invention improve the method and apparatus for producing multi-color changeable patterns of multi-colored lights, by using an intelligent circuit to create the drive signals. According to certain disclosed embodiments of the invention, the appearance of the light patterns are changed automatically or in response to external influences.

10 Claims, 10 Drawing Sheets

METHOD AND APPARATUS FOR USING AN ELECTRICALLY ILLUMINATED ATTENTION-ATTRACTING DEVICE

BACKGROUND OF THE INVENTION

1. Field of the Invention

The present invention relates in general to a new and improved method and apparatus for using an electrically illuminated attention-attracting device. It is more particularly related to such a method and apparatus for controlling the operation of a multi-color light emitting attention-attracting device.

2. Related Art

U.S. Pat. No. 6,206,537, entitled "ELECTRONICALLY ILLUMINATED ATTENTION-ATTRACTING DEVICES AND METHODS OF USING SAME" discloses a circuit for causing a multi-color light source to produce patterns of light such as red and green, as the light source is moved, and this patent is incorporated herein by reference. The patented circuit produces a pattern of light images of equal length bars of alternating colors when the device moves through a path of travel.

BRIEF DESCRIPTION OF THE DRAWINGS

In the following, the invention will be explained in further detail with reference to the drawings, in which.

DESCRIPTION OF CERTAIN EMBODIMENTS OF THE INVENTION

The disclosed embodiments of the present invention improve the method and apparatus for producing multi-color changeable patterns of multi-colored lights, by using an intelligent circuit to create the drive signals. According to certain disclosed embodiments of the invention, the appearance of the light patterns are changed automatically in response to external influences.

The changeable multi-colored light patterns are interesting and pleasing in appearance. Also, the pattern can be controlled by the user to create surprising and amusing designs with the multi-colored light patterns.

Figure 1:
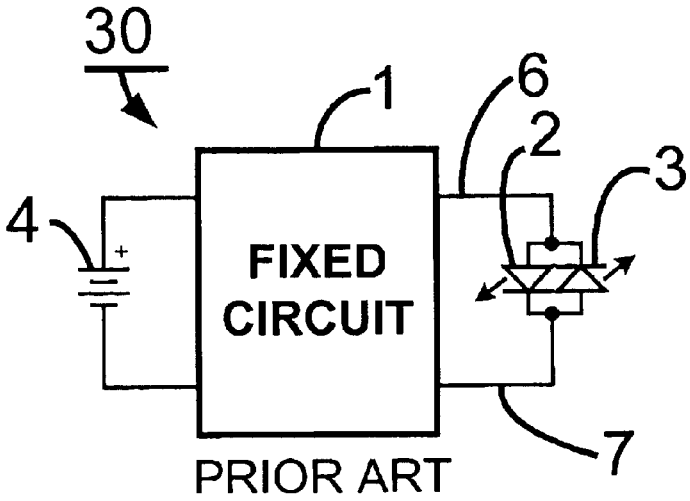
FIG. 1 is a block diagram of a prior art attention-attracting device disclosed in greater detail in U.S. Pat. No. 6,206,537.

Referring now to the drawings, FIG. 1 illustrates an attention-attracting device 30, which is prior art and which is disclosed in greater detail in U.S. Pat. No. 6,206,537. The device 30 includes a fixed control circuit 1 in the form of an astable multivibrator, a battery 4, and two different-colored light emitting diodes (LEDS) 2 and 3. The circuit 1 creates drive signals via leads 6 and 7 for LEDS 2 and 3 that display fixed light patterns. For example, the drive signals activate alternatingly the red LED 2 50% of the time, and the green LED 3 50% of the time to cause a fixed light pattern of alternating red and green light bars when the device 30 is moved along a path of travel.

Figure 2:
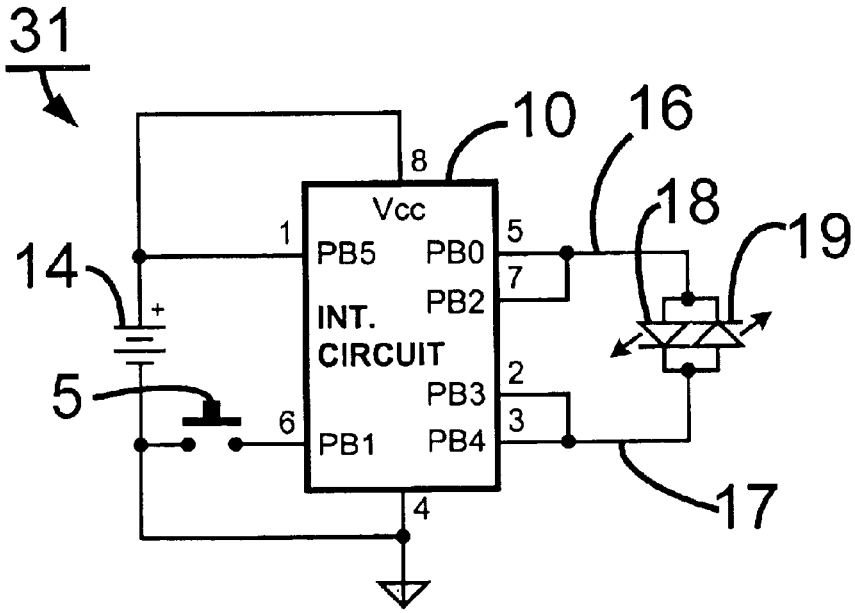
FIG. 2 is a representative schematic diagram of an attention-attracting device, which is constructed in accordance with an embodiment of the present invention.

As shown in FIG. 2, an improved attention-attracting device 31 is constructed according to an embodiment of the present invention, and includes an intelligent circuit 10 for varying drive signals via leads 16 and 17 connected to a pair of parallel-connected, reversely-poled LED devices 18 and 19 to produce changing patterns of light when the device 31 is moved along a desired path of travel such as revolving it in a circle, or along a rectilinear direction. The movement of the device 31 can be produced by a variety of techniques such as those indicated in U.S. Pat. No. 6,206,535, as well as others. In addition, a control in the form of a manually activated normally open switch 5 is coupled to an intelligent circuit 10, for modifying the drive signals via the leads 16 and 17 to the LED devices 18 and 19, in response to an outside influence, for example, in the form of the control switch 5 being closed momentarily by the user.

The intelligent circuit 10 is in the form of a suitable microprocessor programmed by firmware as hereinafter described in greater detail, to change the light pattern produced by the LEDs 18 and 19 in an automatic manner, until interrupted by the switch 5. Although a microprocessor circuit 10 is shown in FIG. 2, it will be understood to those skilled in the art that any suitable form of intelligence devices such as, for example, an Application Specific Integrated Circuit (ASIC) (not shown), a Programmable Logic Device (PLD) (not shown), or other technique may be used as the intelligent circuit 10. The microprocessor intelligent circuit 10 in FIG. 2 may be manufactured by Atmel Corp of 2325 Orchard Parkway, San Jose Calif., 95131, and sold under the part number "AtTiny12L". This microprocessor features a small, 8-pin package and an accurate internal time base requiring few or no external components.

FIGS. 3A–3F illustrate waveforms for drive signals supplied by the circuit 10 via leads 16 and 17 that implement one manner in which the observed patterns of light from LEDS 18 and 19 may be changed by the intelligent circuit 10. The six figures of FIGS. 3A–3F illustrate a sequence in time of continuously changing electrical pulses, which vary with time as indicated.

Figure 3A:
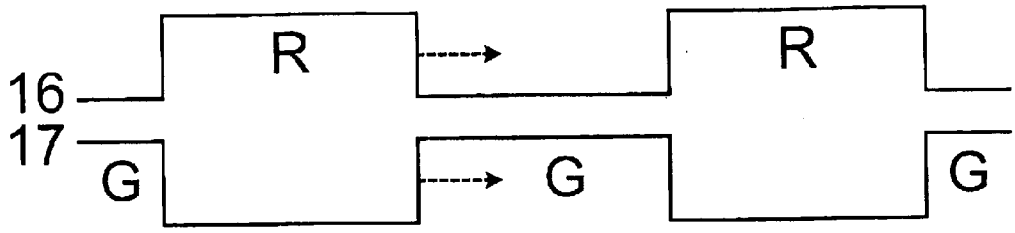
FIGS. 3A, 3B, 3C, 3D, 3E and 3F are waveform diagrams useful in understanding the operation of the device of FIG. 2.
Figure 3B:
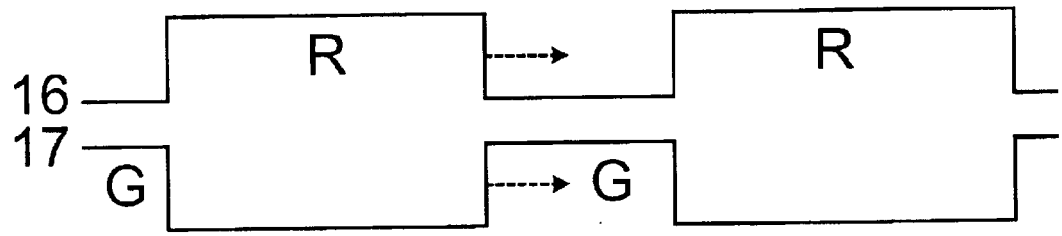
Figure 3C:
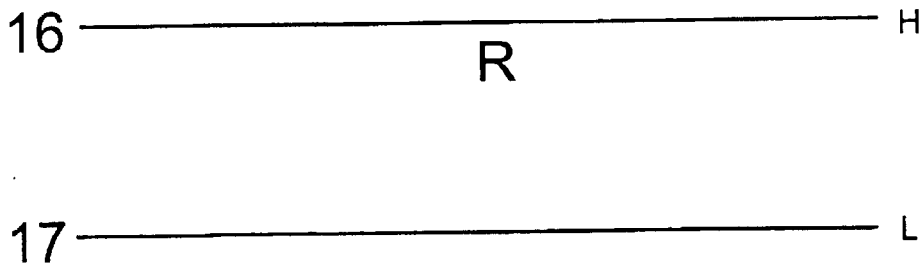
Figure 4:
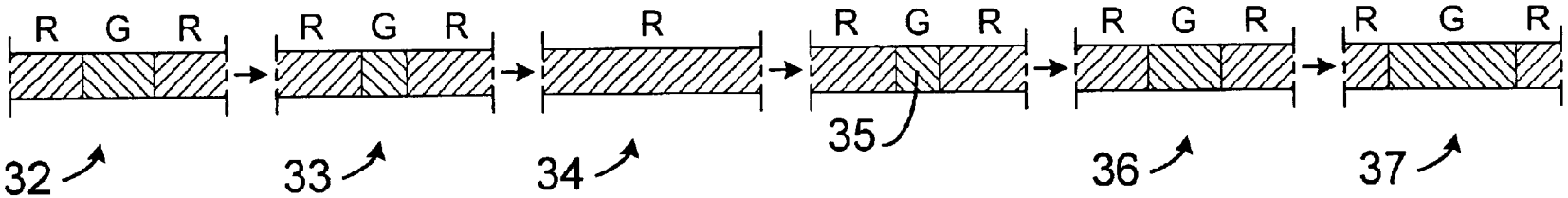
FIG. 4 is a diagram illustrating a light output pattern of the device of FIG. 2.

To operate device 31, the user switches it on by briefly touching or tapping the switch 5, and begins moving the light-emitting device through a desired path of travel in space, for example in a circle as indicated in U.S. Pat. No. 6,206,537. As the light emitting device 31 revolves in a circular or other path of travel in a similar manner as disclosed in U.S. Pat. No. 6,206,537, those watching the device first see a series of equal-length alternating color bars such as red and green color bars as produced by the electrical waveforms shown in FIG. 3A. The pattern of multi-colored light is indicated in FIG. 4 at 32. Then, to the surprise of onlookers, the red bars begin to grow or increase in length, and the green bars begin to shrink or decrease in length, by equal amounts or linearly proportionately relative to one another, as shown in FIG. 4 at 33. This continuous change in the light pattern is caused by the waveform edge of the signals on leads 16 and 17 as annotated by the dotted arrows in FIG. 3A, and by FIG. 3B, which indicates a moment in time when the red bars are approximately twice the length as the green bars. Finally, as shown in FIG. 4 at 34, the moving light pattern is a solid red bar as caused by the signals on leads 16 and 17 as shown in FIG. 3C.

Figure 3D:
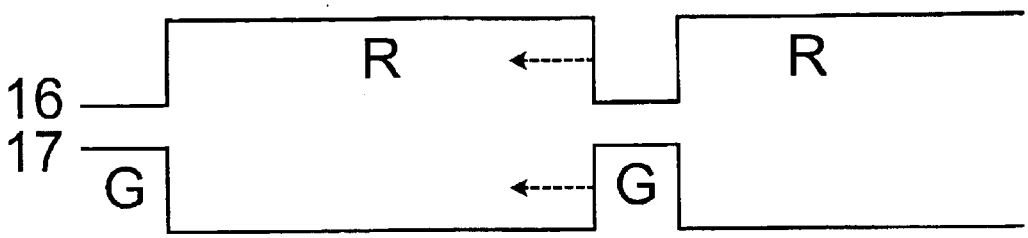
Figure 3E:
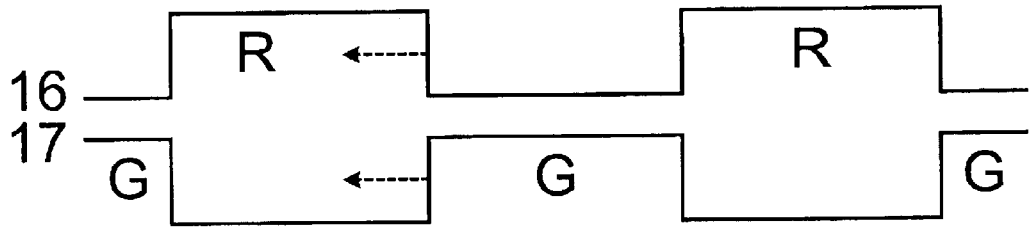
Figure 3F:
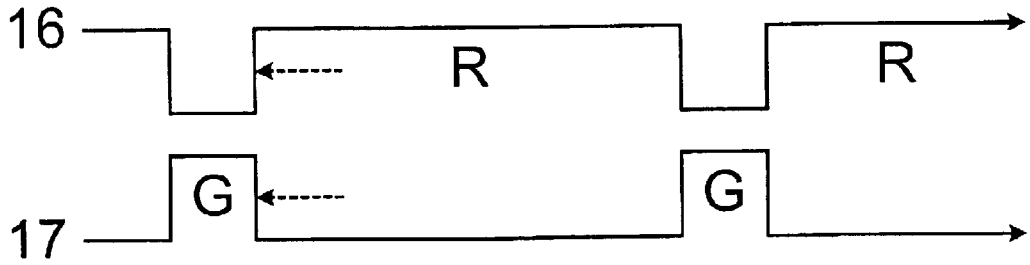

After a brief time interval of solid red at 34, the moving display begins to show a small but growing or increasing length of spaced-apart green bars such as a small green bar 35 in FIG. 4 in addition to the red bars, as shown by the dotted arrows in the waveforms for the signals on leads 16 and 17 as shown in FIG. 3D. The green bars grow or increase in length (and the red bars correspondingly and inversely proportionately shrink or decrease in length) until the red and green bars return to equal lengths, as shown in FIG. 4 at 36, and as indicated in FIG. 3E for the waveforms for leads 16 and 17. The green bars continue to grow or increase in length as the red bars shrink or decrease in length (FIG. 3F and FIG. 4 at 37), until the moving light pattern is a solid green bar (not shown). After a brief interval, the red bars appear as very short bars (not shown) and begin to increase in length, until the displayed pattern returns to equal-length alternating red and green bars in a manner similar to the pattern as indicated at 32 in FIG. 4. This cycle repeats until the user intervenes.

The cycle of changing light bar patterns repeats until the user presses the pushbutton switch 5 (FIG. 2) to supply a signal to the circuit 10. Pressing the button 5 causes the lengths of each color bar to freeze, and to maintain their lengths until the user again presses the button. In this way the user may wait until the pattern is one that he or she prefers, and then actuate the button to freeze the pattern. This behavior is diagrammed as a state diagram in FIG. 5.

Figure 5:
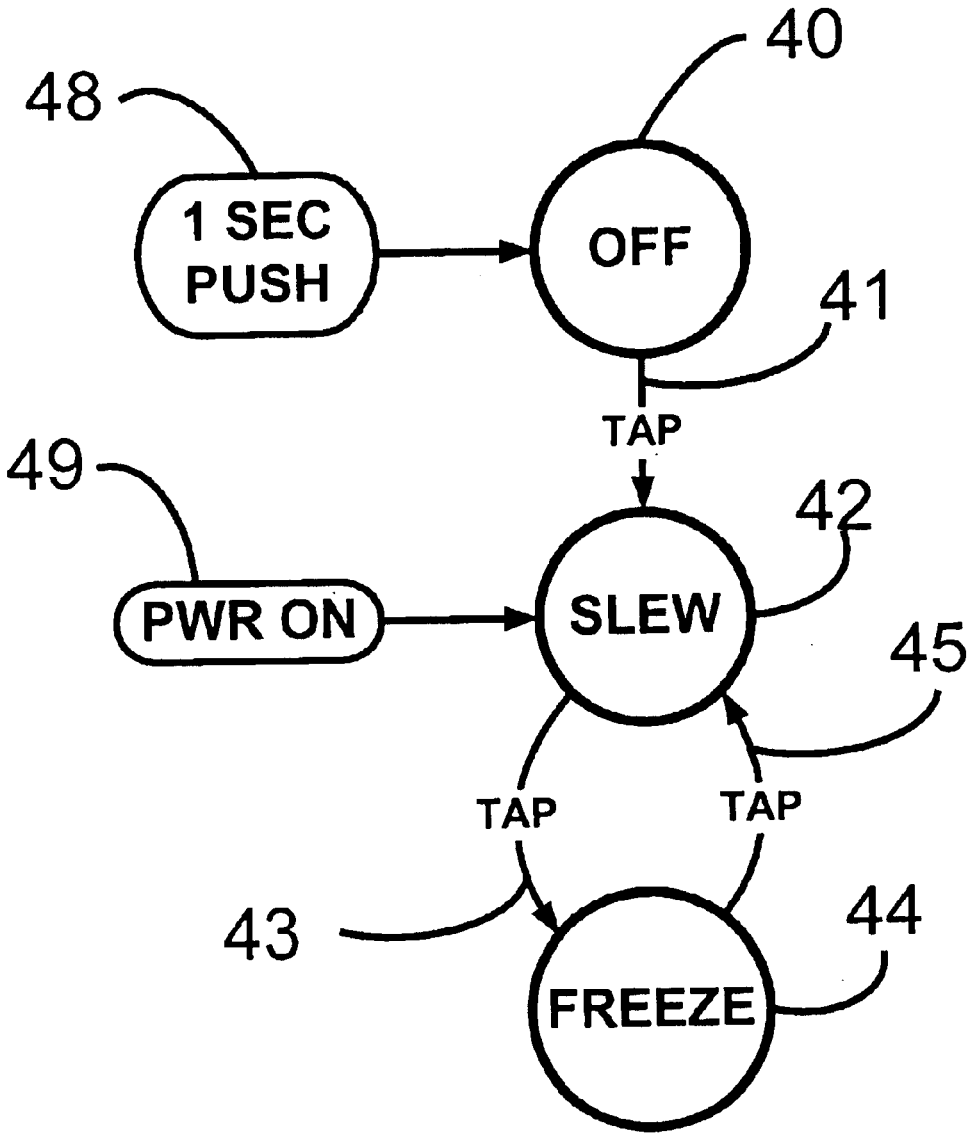
FIG. 5 is a state diagram illustrating the operation of the device of FIG. 2.

Turning now to FIG. 5, power is applied to device 31 at 49 by tapping the switch 5, whereupon it enters a SLEW state 42. This state constantly changes the displayed bar size as previously described: increasing red, holding solid red for a brief interval, increasing green, holding solid green for a brief interval, etc. If the user taps the button 5 as shown by transition 43, the device 31 enters a FREEZE state 44, in which the bar sizes remain fixed at their current values. Tapping the button 5 again causes transition 45, by which the device 31 resumes the SLEW state, and continues the bar pattern where it left off when the tap 43 occurred.

For the present example, a button "tap" (as indicated at 41, 43, and 45) is a button press of less than one second, and a push 48 is a button press of more than one second. If the button 5 is held down more than one second, the device 31 enters an OFF state 40, which consumes very little power (typically less than a microamp for the AtTiny12 microprocessor). Once in the OFF state 40, a button tap turns the device 31 back ON to resume operation.

Figure 6:
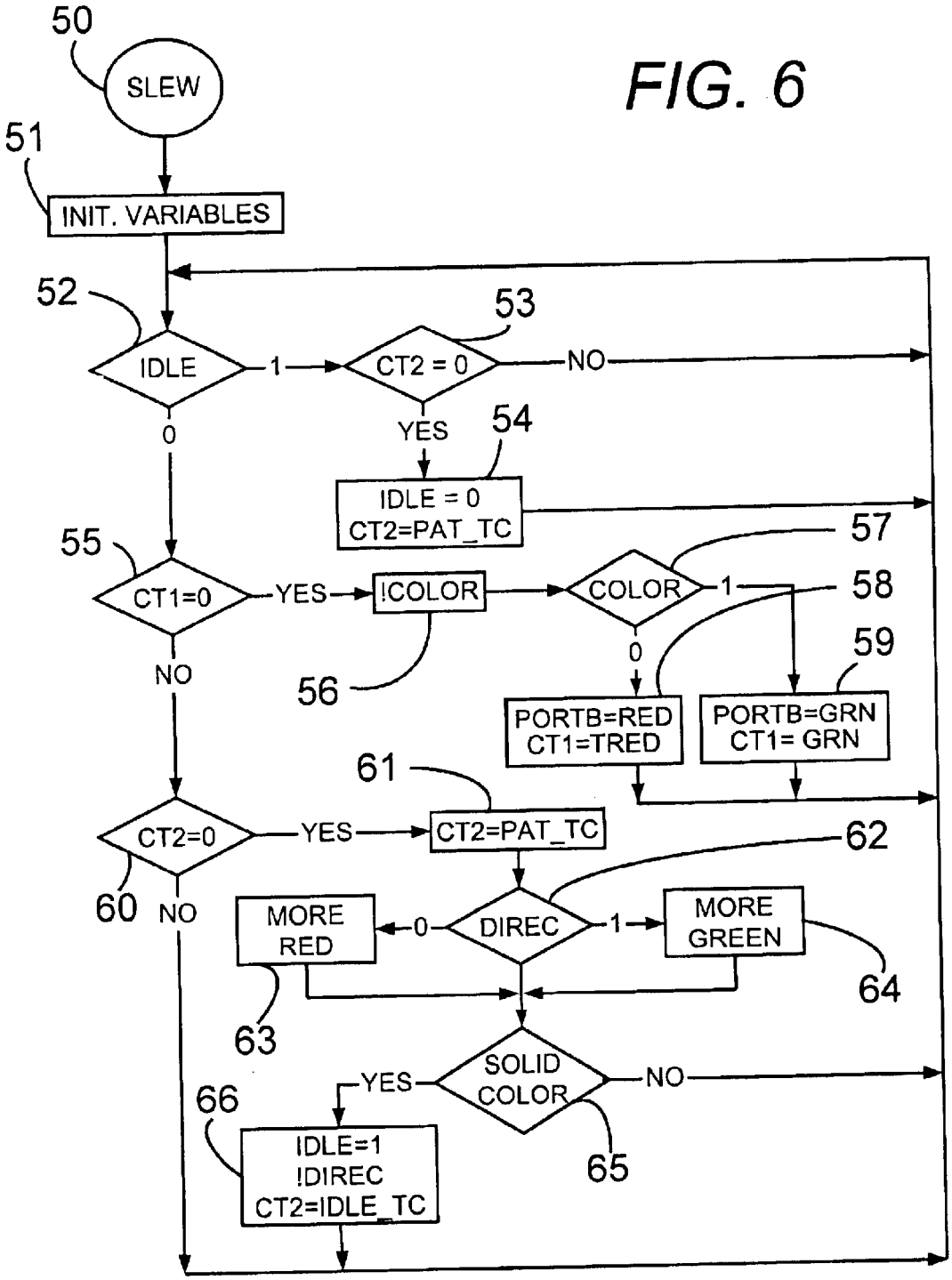
FIG. 6 is a flowchart diagram describing steps in the operation of the device of FIG. 2.

An accompanying Appendix A contains a code listing of the firmware for the microprocessor intelligent circuit 10 to implement the described operation. As an aid to understanding the firmware, FIG. 6 is a flowchart for the main code. The FIG. 6 flowchart defines and specifies the SLEW state 42 of FIG. 5. Three software flags are updated and interrogated as the SLEW state operates.

IDLE=1 indicates the "dead time" interval, when one of the color bars is on fully and the other is off.

COLOR=0 indicates that the current LED color is red, and COLOR=1 indicates that the current LED color is green.

DIREC=0 indicates that the slew direction is to increase red and decrease green, and DIREC=1 indicates that the slew direction is to increase red and decrease green.

Two general-purpose software counters are used to time the various time intervals. These counters are decremented in an interrupt service routine (ISR) that triggers whenever a periodic time ("Timer/Counter" in the AtTiny microprocessor) reaches a count limit. Counter "ct1" counts an interval representing the length of time to display the current bar. Two program variables, "Tred" and "Tgrn" hold count values to be loaded into ct1, depending on which color is being displayed.

A second software counter "ct2", also decremented by the Timer/Counter ISR is used for two purposes. When the IDLE flag is 1, ct2 counts the time interval representing the "dead time" during which only a single solid color is displayed. When this time expires, the firmware sets IDLE=0, and re-initializes ct2 to the value "PAT_TC" to serve as a pattern counter, which when expired indicates that it is time to modify the displayed bar lengths. If the user taps the button 5, a 'HOLD' flag is set and tested in the timer ISR. If HOLD=1, ct2 is inhibited from counting, which freezes the display at its current values of Tred and Tgrn. These operations are shown in the "timer_isr" and "int0_isr" code sections in Appendix A, and for clarity, are not shown in the FIG. 6 flowchart.

Turning now to the flowchart of FIG. 6, the SLEW state commences at 50, which advances to 51 to initialize program variables, and then to three decision blocks 52, 55 and 60. Decision block 52 checks the state of the IDLE flag. If IDLE=0 neither bar is a solid color, and the slewing continues by moving to decision block 55. At decision block 55 the ct1 count is checked for zero, indicating that it is time to change display colors. If the count is non-zero, decision block 60 is entered, where the second count ct2 is checked for zero, indicating that it is time to change the displayed pattern, i.e., the length of the red and green bars. Usually, the states 52, 55 and 60 are traversed in a loop, waiting to take an action.

Considering now the loop 55–59, when the software timer ct1 times out, decision block 55 indicates "YES", the state of the COLOR flag is complemented in 56, which proceeds to decision block 57. Decision block 57 examines the state of the COLOR flag, and branches either to 58 or 59. If COLOR=0 in decision block 57, control passes to 58, where the output port is written with the bit pattern to turn the red LED on and the green LED off, and the current on-time associated with the red LED (tRed) is loaded into the software counter ct1. Conversely, If COLOR=1 in decision block 57, control passes to 59, where the output port is written with the bit pattern to turn the green LED on and the red LED off, and the current on-time associated with the green LED (tGrn) is loaded into the software counter ct1. In either case control passes back to the main loop at 52.

When decision block 60 detects that the pattern count (ct2) has timed out, it is time to change the displayed pattern, i.e. the on-times of the red and green bars. Block 61 initializes ct2 with the pattern time-constant PAT_TC and then decision block 62 determines the slew direction by examining the DIREC flag as previously described. If DIREC=0 then more red is indicated, and control passes to 63, where a constant number (DELTA in the Appendix A listing) is added to tRed and subtracted from tGrn. Conversely, if DIREC=1 then more green is indicated, and control passes to 64, where a constant number (DELTA) is added to tGrn and subtracted from tRed. Once the color bar times are adjusted, the decision block 65 checks to determine if either solid color is displayed. If not, the main loop is again entered at 52. If a solid color is indicated, 66 initiates the idle state by setting the flag IDLE=1, complementing the DIREC flag so that the slewing will change directions, and finally initializing software count ct2 to an idle time value IDLE_TC.

Considering finally the last event to which the main loop 52–55–60 responds, decision block 52 checks the state of the idle flag. If IDLE=1, block 53 checks for ct2 reaching its terminal count, and if it has not, resumes the main loop at 52. Since the IDLE flag is the first flag tested in the main loop, while in "idle" only decision blocks 52 and 53 are active, which shuts down any other activity, only displaying a solid red or green bar for the time indicated by IDLE_TC. When decision block 53 detects that the idle time has expired, 54 resets the IDLE flag, and re-initializes the ct2 software counter to serve again as the pattern change counter to be tested at 60.

Figure 7:
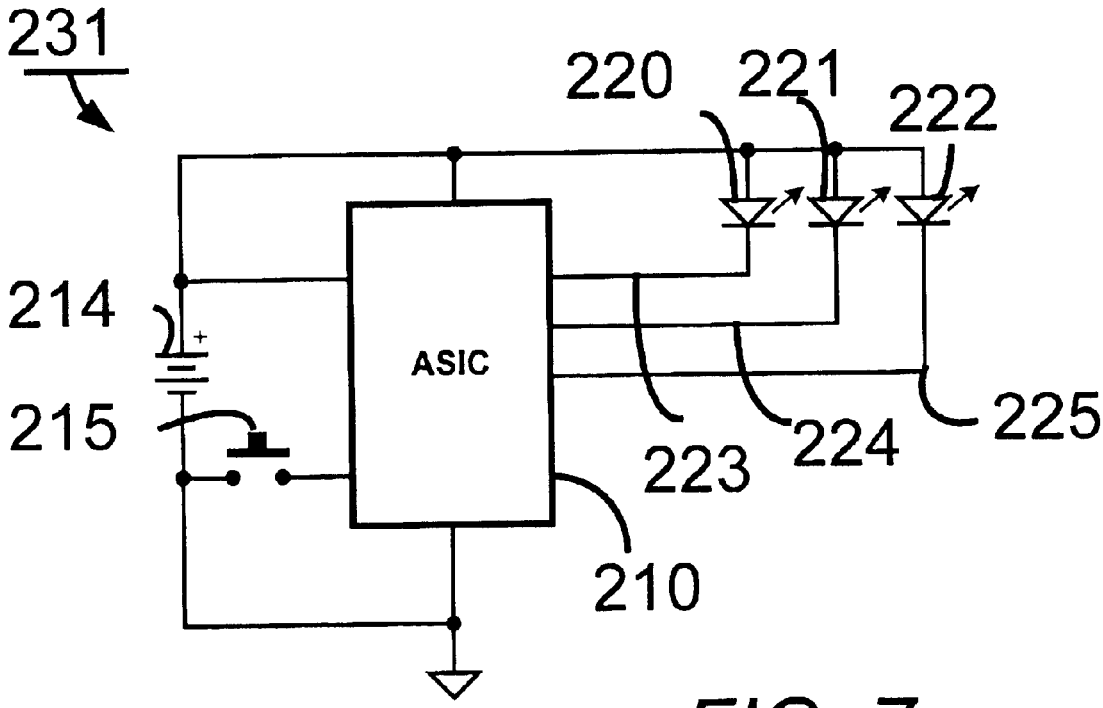
FIG. 7 is a representative schematic diagram of another attention-attracting device, which is also constructed in accordance with another embodiment of the present invention.

As shown in FIG. 7, an attention-attracting device 231 is similar to the device 31, except that the device 231 includes three LED indicators, each emitting a different colored light. The device 231 includes three LED indicators 220, 221 and 222, driven by three signals via leads 223, 224, 225 from intelligent circuit 210, which is similar to the circuit 10 of FIG. 2, except that it is an ASIC device for executing algorithm based on a predetermined program that the LED indicators produce a visually perceptible, changing light pattern including a sequence of alternating three colored light bar images. At least one of the colored light bar images change continuously according to the predetermined program, such as the changing light patterns similar to the changing light pattern of FIG. 4 as produced by the device 31 of FIG. 2. The device 231 emits a pattern of alternating sequence of red, green and blue light bars when the device 231 moves. A representative 3-LED device that includes red, green and blue LEDS in the same package is manufactured by Ledtronics, Inc. of 23105 Kashiwa Court, Torrance Calif. 90505, and sold under the part number "DIS-1024-107".

It will become apparent to those skilled in the art that the basic principles of the invention may be extended to any number of light-emitting devices or other output devices, and to any control means or circuit that may be interfaced to an intelligent circuit or other device. The device 231 operates in a similar manner as the device 31, except that three different alternating colored bars are emitted therefrom in an automatically and continuously changing light pattern.

Figure 8:
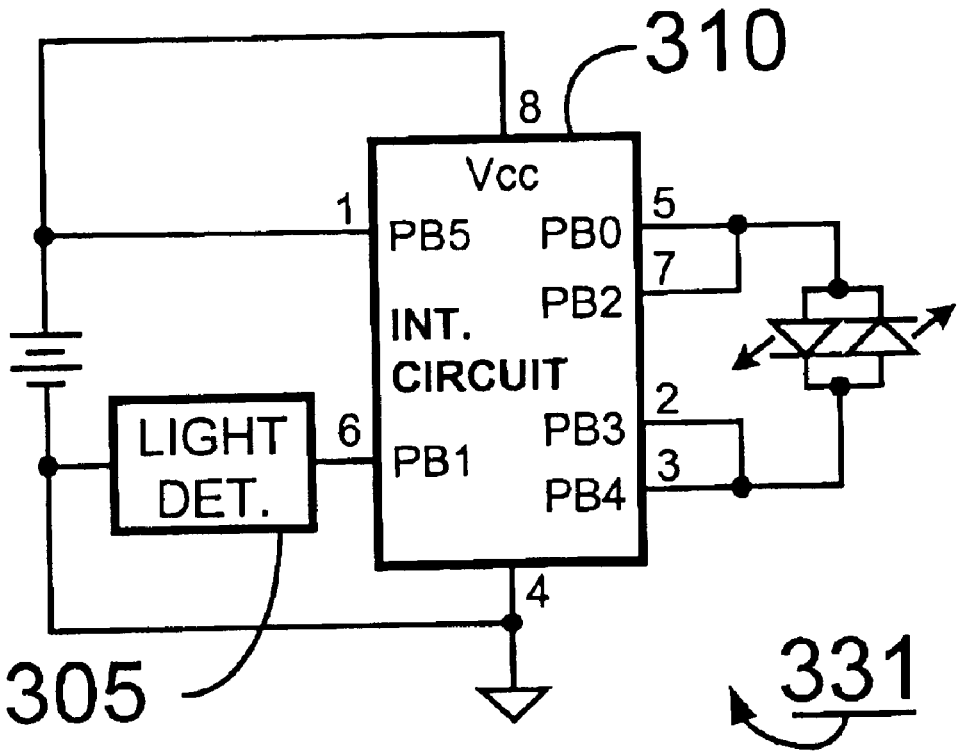
FIG. 8 is a representative schematic diagram of yet another attention-attracting device, which is also constructed in accordance with yet another embodiment of the present invention.
Figure 9:
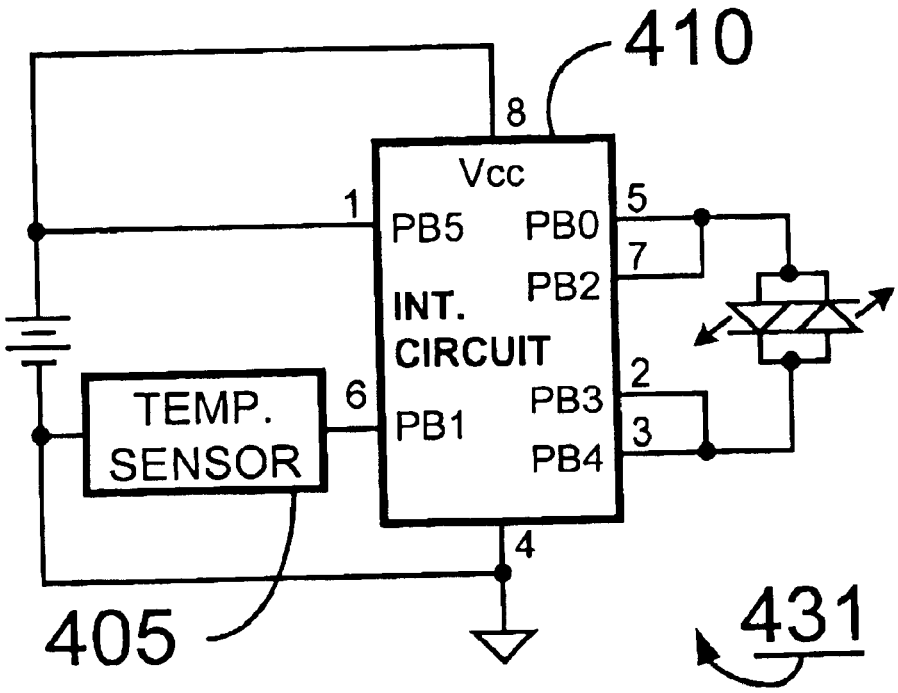
FIG. 9 is a representative schematic diagram of a further attention-attracting device, which is also constructed in accordance with a further embodiment of the present invention.

Considering now FIG. 8, there is shown an attention-attracting device 331, which is constructed according to another example of the present invention, and which is generally similar to the device 31, except that the device 331 includes a light detector device 305 in place of the push-button switch 5. The device 331 includes a light detector device 305 to influence the displayed light patterns. In this regard, the device 305 is responsive to changing ambient light intensities, which interrupt periodically the changing colored light patterns produced by the device 331. FIG. 9 uses a temperature sensor 405 to influence the displayed light patterns, and FIG. 10 uses a microphone 505 to influence the displayed light patterns.

Although the circuits described in this invention illustrate two or three color devices, any number of colors are contemplated. Many other modulating patterns may be accomplished by the intelligent circuit of the disclosed embodiments for creating the light emitting device drive signals. Similarly, many other control means or other devices may be employed such, for example, as sound input, motion detection, temperature or other inputs.

In FIG. 9, there is shown an attention-attracting device 431, which is constructed according to still another example of the present invention, and which is generally similar to the device 31, except that the device 431 includes a temperature sensor 405 in place of the push-button 5. The sensor 405 responds to temperature to influence the displayed light patterns of the device 431.

Figure 10:
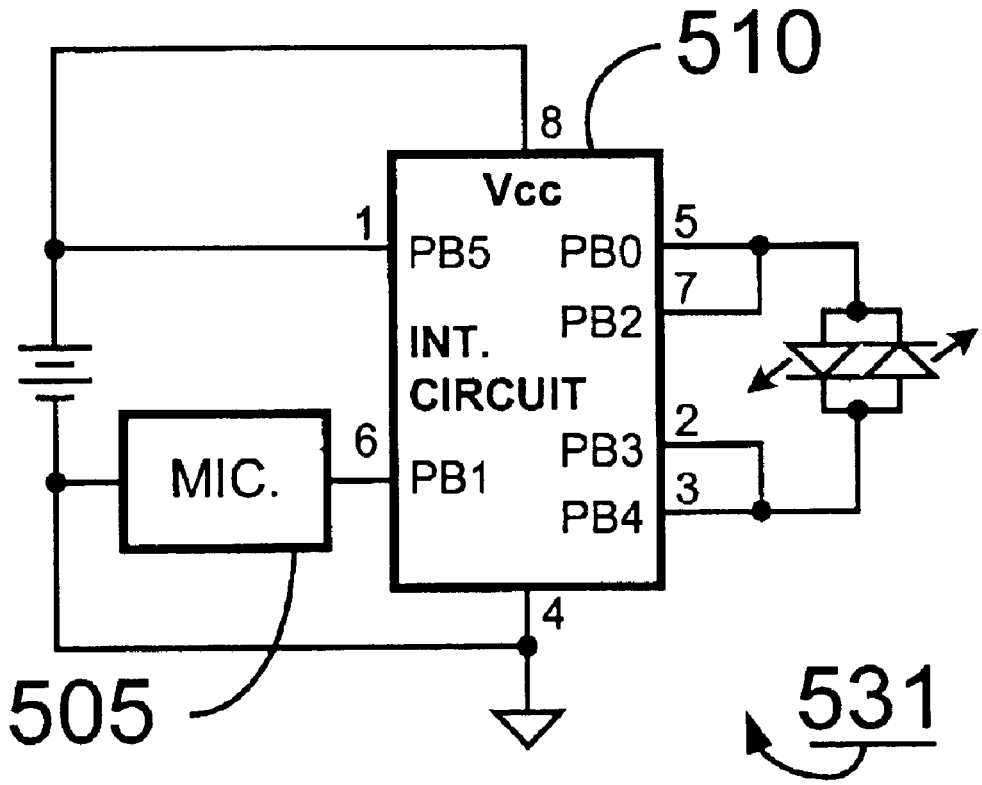
FIG. 10 is a representative schematic diagram of still another attention-attracting device, which is also constructed in accordance with still another embodiment of the present invention.

Referring now to FIG. 10, an attention-attracting device 531 is constructed according to yet another example of the present invention, and is generally similar to the device 31. However, the device 531 includes a microphone 505 which is responsive to audible signals to influence the displayed patterns produced by the device 531.

While the invention has been described with reference to specific drawings and embodiments, modifications and variations thereof may be made without departing from the true spirit and scope of the invention which is defined in the following claims. For example, the changing patterns of light bars can be altered in a variety of ways including, but not limited to, for example, three light bars where only one of the bars blinks on and off at a time. Thus, there are many different versions of the changing light bar patterns as contemplated by the present invention.

What is claimed is:

1. A method of producing attention-attracting light images, comprising:

causing a light source to emit alternatingly at least two different colored lights from a light-emitting device;

producing a visually perceptible light pattern comprising a sequence of at least alternating first and second colored light bar images visible when moving the light-emitting device at a certain speed;

increasing the length of the first colored light bar images at said certain speed;

decreasing the length of the second colored light bar images substantially simultaneously with the increasing the length of the first light bar images at said certain speed; and responding to external influences to control said increasing and said decreasing of the light bar images to alter the pattern.

2. A method according to claim 1, further including stopping the increasing and decreasing of the first and second colored light bar images while continuing to move the light-emitting device at said certain speed and while causing the common light source to emit alternatingly the at least two different colored lights.

3. A method according to claim 1, wherein said increasing and decreasing continues automatically until the second colored light bar images diminish completely, and then increasing the second colored light bar images in length.

4. The system according to claim 1, further including interrupting the causing of the lengths of the first and second colored light bar images to change in response to the external influences to freeze the pattern so that the length of the colored light bar images are maintained.

5. A method according to claim 4, wherein said external influences include actuating a manual switch.

6. A method according to claim 4, wherein said external influences include a light detector device.

7. A method according to claim 4, wherein said external include sensing temperature.

8. A method according to claim 4, wherein said external influences include responding to external audible sounds by using a microphone.

9. A method according to claim 1, wherein said light source emits at least three different colored lights so that a sequence of alternating first, second and third colored light bar images is emitted when the light-emitting device moves.

10. A method providing attention-attracting images, comprising:

causing a multi-colored light source to emit alternatingly at least two different colored lights;

causing the light source to produce a visually perceptible, changing light pattern including a sequence of at least alternating first and second colored light bar images when the light source moves at a given speed;

causing the length of at least one of said colored light bar images to change continuously as the length of at least another one of said colored light bar images decreases according to a predetermined program as the light source moves at said given speed; and interrupting said causing the length to change, and freezing the pattern at its interrupted condition to maintain the lengths of the colored light bar images.

* * * * *

UNITED STATES PATENT AND TRADEMARK OFFICE

CERTIFICATE OF CORRECTION

PATENT NO. : 6,817,734 B2
DATED : November 16, 2004
INVENTOR(S) : Lane T. Hauck

It is certified that error appears in the above-identified patent and that said Letters Patent is hereby corrected as shown below:

Column 6,
Line 64, delete "external influences to freeze the pattern so that the length of" insert -- external influences to freeze the pattern so that the lengths of --

Column 7,
Line 4, delete "include sensing temperature." insert -- influences include sensing temperature. --

Signed and Sealed this

Eighth Day of February, 2005

JON W. DUDAS
*Director of the United States Patent and Trademark Office*